United States Patent [19]

Maier

[11] 4,372,001

[45] Feb. 8, 1983

[54] CARPET DYEING SYSTEM WITH MOVABLE SQUEEGEE ROLL

[75] Inventor: H. Armin Maier, Calhoun, Ga.

[73] Assignees: Gowin-Card, Inc.; Tuftco Corporation, both of Chattanooga, Tenn.

[21] Appl. No.: 243,087

[22] Filed: Mar. 12, 1981

[51] Int. Cl.[3] ..... D06B 1/14; D06B 11/00

[52] U.S. Cl. ..... 8/151; 68/203; 118/204; 427/288; 427/428

[58] Field of Search ..... 8/149, 151; 68/202, 68/203; 118/204; 427/288, 428; 101/172, 178

[56] References Cited

U.S. PATENT DOCUMENTS

| | | | |
|---|---|---|---|
| 626,270 | 6/1899 | Chambon | 101/181 |
| 2,033,618 | 3/1936 | Foley et al. | 101/178 |
| 2,033,641 | 3/1936 | Moffatt | 101/178 |
| 2,240,249 | 4/1941 | Wickwire, Jr. | 101/178 |
| 2,308,117 | 1/1943 | Snyder | 101/25 |
| 2,789,498 | 4/1957 | Lew | 101/181 |
| 2,997,952 | 8/1961 | Horrocks et al. | 68/202 X |
| 3,099,146 | 7/1963 | Yamawaki | 68/203 |
| 3,492,840 | 2/1970 | Korsch | 68/202 |
| 3,530,692 | 9/1970 | Schweizer et al. | 68/202 |
| 3,964,860 | 6/1976 | Leifeld | 68/203 X |
| 4,157,652 | 6/1979 | Mathes et al. | 68/62 X |

FOREIGN PATENT DOCUMENTS

| | | | |
|---|---|---|---|
| 1348232 | 3/1974 | United Kingdom | 118/204 |

*Primary Examiner*—Philip R. Coe

*Attorney, Agent, or Firm*—Thomas & Kennedy

[57] ABSTRACT

Dye is applied to the lower surface of a dye pickup roll for transfer to the pile surface of a length of carpet, and a squeegee roll engages the dye pickup roll after the dye has been applied to the pickup roll and before the dye is transferred from the pickup roll to the carpet. The external surface of the squeegee roll is approximately cylindrical with a multiple number of depressions formed therein, and the squeegee roll can be rotated and reciprocated with respect to the dye pickup roll, so that its high spots tend to wipe or "squeegee" the liquid dye from the surface of the dye pickup roll and its depressions or low spots tend to permit the dye to pass beyond the squeegee roll on the pickup roll in a pattern and move with the pickup roll into contact with the pile surface of the carpet. When the squeegee roll is reciprocated, it tends to prevent the pattern from being repeated on the dye pickup roll and on the carpet. When the squeegee roll is not reciprocated or when it is reciprocated in timed relationship with respect to its rotation, a repeat design can be applied to the carpet.

9 Claims, 5 Drawing Figures

CARPET DYEING SYSTEM WITH MOVABLE SQUEEGEE ROLL

BACKGROUND OF THE INVENTION

One of the common procedures for printing on sheet material is to apply the liquid ink or dye in the form of a pattern to a dye pickup roll and then transfer the patterned dye to the sheet material by contacting or by dropping dyes onto the sheet material with the pickup roll. While these techniques have been utilized for years in printing on paper and on other relatively solid sheets of material, these techniques also have been utilized in more recent years in "printing" designs on the face of pile carpeting, such as tufted carpet. Printing on the face of carpet is effective when a repeating check or plaid design is to be formed on the face of the carpet; however, the conventional printing procedure is not so effective when it is desired to have the carpet formed with a non-repeat design. For example, some purchasers ask for carpet that bears a design that may include various streaks, flecks, patches or other design variations, but the purchaser does not want to have the design repeated every so often along the length of the carpet. However, the usual techniques suitable for printing on the face of carpet have not provided the desired non-repeat patterns, and the carpet manufacturers have been required to utilize other carpet manufacturing procedures to achieve a non-repeat random pattern product, as for example, tufting carpet with space dyed yarns.

SUMMARY OF THE INVENTION

Briefly described, the present invention comprises a method and apparatus for dyeing carpet with a pile surface and other sheet material with a printing process, where dye is formed in a pattern on a dye pickup roll and the patterned dye is transferred from the pickup roll to the face of the sheet material. A squeegee roll contacts the dye pickup roll and forms the dye on the dye pick up roll in a pattern before the dye is transferred to the sheet material.

The squeegee roll includes an exterior surface that is approximately cylindrical and a plurality of depressions or recesses are formed in its surface. The squeegee roll usually is placed in rolling contact with the dye pickup roll and its high surfaces tend to wipe or "squeegee" the liquid dye off the dye pickup roll while its low surfaces tend to permit the dye to pass on beyond the squeegee roll. The squeegee roll can be reciprocated with respect to the dye pickup roll so that the pattern left by the squeegee roll on the dye pickup roll is not repeated in line with the previously formed pattern but is offset to the right and to the left in a random pattern, depending upon the direction, amplitude and frequency of reciprocation of the squeegee roll. However, when it is desirable to form a repeated pattern on the face of the sheet material the squeegee roll is rotated in unison with the transfer roll but the squegee roll is not reciprocated so that its pattern is repeated on the transfer. Another procedure for forming a repeat pattern is to reciprocate the squeegee roll but coordinate its reciprocation with its rotation so as to repeat the pattern on the transfer roll.

Thus, it is an object of this invention to provide a method and apparatus for applying dye to the pile surface of carpet and other sheet materials wherein some of the conventional printing techniques can be utilized, but wherein the pattern to be applied to the sheet material is not necessarily detected as being a repeated pattern.

Another object of this invention is to provide a method and apparatus for inexpensively applying a repeated or non-repeated pattern to the pile surface of tufted carpet and to the surfaces of other sheet material.

Other objects, features and advantages of the present invention will become apparent upon reading the following specification, when taken in conjunction with the accompanying drawings.

DETAILED DESCRIPTION

Figure 1:
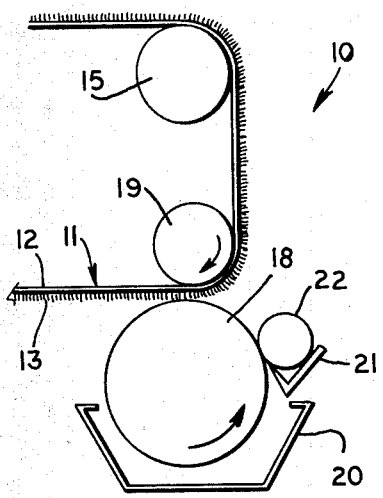
FIG. 1 is a side schematic illustration of the carpet dyeing system.

Referring now in more detail to the drawings, in which like numerals indicate like parts throughout the several views, FIG. 1 illustrates the carpet dyeing system 10 wherein tufted carpet 11 having a backing sheet 12 and a multitude of tufts 13 that form a pile surface is moved through a conveying system from a supply (not shown), to the carpet dyeing system 10, and then on to a curing oven, etc. (not shown). A number of guide rollers such as roller 15 are used to direct the carpet 11 from its source to the carpet dyeing system.

Dye pick up roll 18 is placed along the path of carpet 11 so that it makes rolling contact with the surface of the pile 13 of the carpet. A weight roll 19 is positioned above dye pick up roll 18 and is arranged to engage the backing sheet 12 and to urge the pile 13 of a carpet down into contact with dye pickup roll 18. The carpet is threaded through the system so that its pile surface 13 faces downwardly when it passes over dye pickup roll 18, and as weight roll 19 engages the back surface of the carpet. Both dye pickup roll 18 and weight roll 19 are mounted at their ends in bearings (not shown), and weight roll 19 idles in its bearings. Dye pickup roll 18 is a driven roll, and is driven so that its surface velocity is equal to the linear velocity of the carpet 11 moving through the system.

Dye pan 20 is positioned immediately below dye pickup roll 18, and a supply of liquid dye is maintained in dye pan 20. An elongated fixed guide 21 is supported in closely spaced relationship with respect to dye pickup roll 18, and a squeegee roll 22 is supported by fixed guide 21 in abutment with dye pickup roll 18. Thus, the dye pan 20 and its related elements function as a means for applying the liquid dye to the pickup roll 18.

Figure 3:
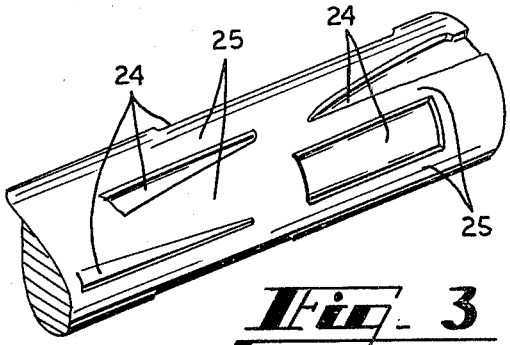
FIG. 3 is a detail perspective illustration of the squeegee roll.

As illustrated in FIG. 3, squeegee roll 22 has an approximately cylindrical exterior surface and a multitude of depressions or recesses 24 are formed in its surface, which leaves a multitude of intermediate high spots 25. The recesses can be formed of varying shapes, orientation and depths on the squeegee roll, depending upon the desired design to be imparted to the sheet material.

Figure 4:
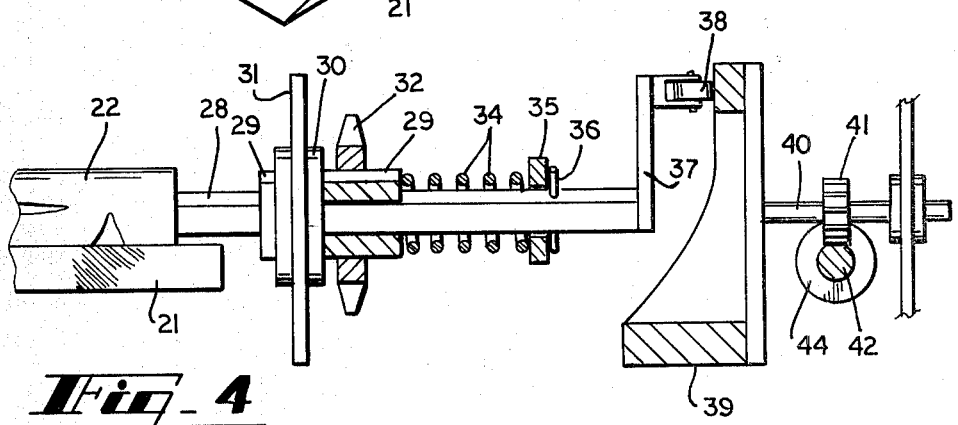
FIG. 4 is a side view of a portion of the squeegee roll and of its rotating and reciprocating mechanism.

As illustrated in FIG. 4, squeegee roll 22 is mounted to a non-circular support shaft 28 which is operative to both rotate and reciprocate the squeegee roll. Driving collar 29 is mounted about non-circular shaft 28 and is supported by bearing 30 in mounting plate 31. Drive sprocket 32 is mounted to collar 29 and a drive chain (not shown) extends about sprocket 32 for connection to a driving motor. Coil compression spring 34 extends about shaft 28 and bears against collar 29. At its other end, spring 34 bears against washer 35 which is mounted to shaft 28 by means of pin 36. With this arrangement, coil compression spring 34 biases washer 35, pin 36, and therefore the entire shaft 28 and squeegee roll 22 to the right (FIG. 4).

The end of shaft 28 which is remote from squeegee roll 22 includes crank arm 37 and cam follower 38 which is offset from the axis of rotation of shaft 28. Cam follower 38 is arranged to engage circular cam 39. Circular cam 39 is mounted on axle 40 and axle 40 has mounted thereto drive gear 41 which is engaged by worm gear 42. Motor 44 drives worm gear 42.

With this arrangement, the squeegee roll 22 is constantly biased by its coil compression spring 34 toward the right of FIG. 4 toward engagement with circular cam 39, and as the squeegee roll is rotated by rotation of its sprocket 32, the circular cam 39 requires the squeegee roll to reciprocate. In order that the pattern being applied by the squeegee be varied as much as possible, the motor 44 and its worm gear arrangement 41, 42 function to rotate circular cam 39, so that the high and low areas of the cam will be located in different positions during successive rotations of the squeegee roll.

Figure 2:
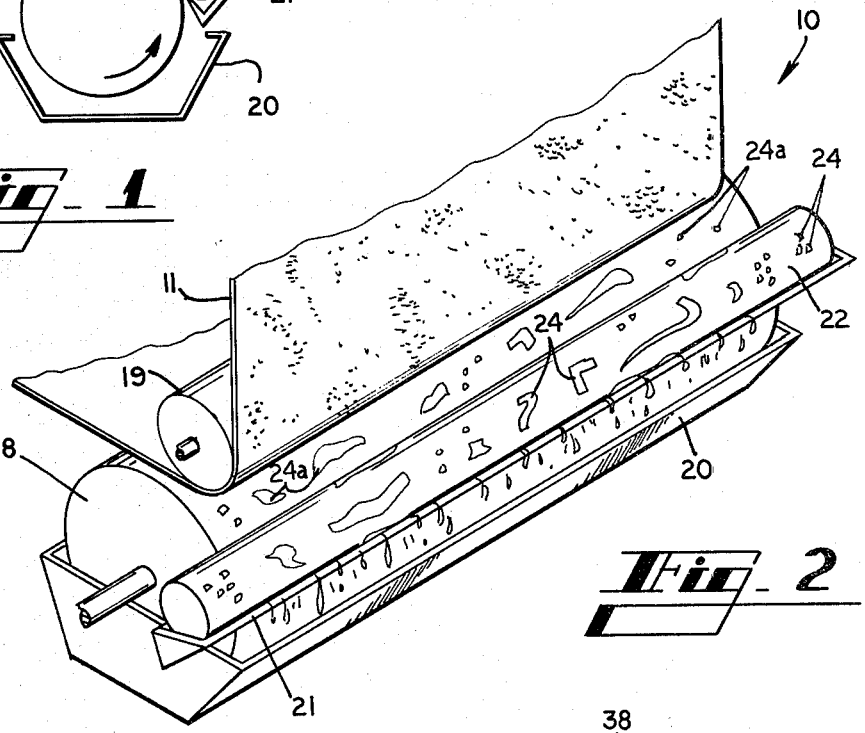
FIG. 2 is a perspective view of the system of FIG. 1.

As illustrated in FIG. 2, the squeegee roll 22 is of a length longer than the length of dye pickup roll 18, so that when squeegee roll 22 is reciprocated, it is long enough so that it always contacts the entire length of dye pickup roll 18. When dye is applied to the rotating pickup roll 18, as when the dye pickup roll 18 rotates and the liquid dye is applied to its bottom surface by immersion of the bottom portion of the roll in the dye pan 20, a substantially uniform layer of dye is carried upwardly from the pan on the surface of the dye pickup roll. When the dye reaches squeegee roll 22, the high spots 25 of squeegee roll tend to remove the dye from those areas that the high spots contact, whereas the low spots tend to pass over the dye and permit the dye to cling to the surface of the dye pickup roll. Thus, the depressions or recesses 24 form correspondingly shaped patterns **24*a* in the dye on the dye pickup roll. Of course, when the squeegee roll 22** is reciprocated, the patterns will be shifted to a different location on the dye pickup roll during the next rotation of the squeegee roll.

Fixed guide 21 is illustrated as being approximately V-shaped, and a number of apertures are formed in the fixed guide over dye pan 20. Thus, the dye that is rejected from dye pickup roll 18 by the squeegee roll 22 is inclined to fall back into dye pan 20, and any dye that momentarily clings to the squeegee roll tends to drip from the squeegee roll into the fixed guide 21 and then through the holes of the fixed guide back to the dye pan 20.

It has been found that the shapes of the patterns **24*a* left by the squeegee roll 22 can be changed by varying the velocity of reciprocation and rotation of the squeegee roll. For example, while a depression 24 may be of a particular length and width in the surface of the squeegee roll, the length of the blotch of dye left by the depression on the pickup roll can be shrunk by longitudinal movement of the squeegee roll during one rotation of the squeegee roll, while the length of the blotch can stay the same length as its depression in the squeegee roll during the next rotation of the squeegee roll by no reciprocation of the squeegee roll. If the squeegee roll is rotated with a surface velocity that is greater or smaller than the surface velocity of the pickup roll, or in a reverse direction with respect to the pickup roll, the shape of the blotches of dye are altered on the pickup roll and on the sheet material. Moreover, the depth of a depression 24 in the squeegee roll dictates the volume of dye to be present in a blotch of dye passing on the dye pickup roll beyond the squeegee roll. For example, if a depression 24** is relatively deep, more dye can be accumulated in the depression as the dye moves beneath the squeegee roll, and therefor more dye is left on the dye pickup roll and eventually is transferred from the dye pickup roll to the sheet material.

When the squeegee roll is reciprocated at varying velocities, which depends on the shape of the circular cam 39 and the varying speed of rotation as applied to the cam by variable speed motor 44, and when the rotational velocity of squeegee roll 22 is varied by varying the speed of the motor connected to sprocket 32, a random pattern of dye is formed on the pickup roll and transferred to the sheet material 11.

Figure 5:
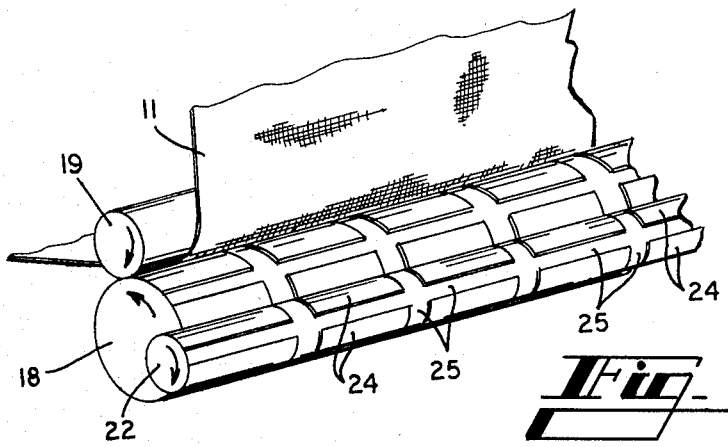
FIG. 5 is a detail perspective view of the squeegee roll, dye pickup roll and a length of sheet material, illustrating a repeated pattern being applied to the sheet material.

As illustrated in FIG. 5, it might be desirable to form a repeated pattern on the sheet material, such as the plaid pattern illustrated on the transfer roll 18. The squeegee roll 22 is formed with its high spots 25 and depressions 24 arranged in the desired pattern and the squeegee roll is not reciprocated but rotates in timed relationship with the pickup roll 18. The resulting pattern applied to transfer roll 18 is substantially identical to that of the squeegee roll and the pattern of the squeegee roll is repeated on the pickup roll for each revolution of the squeegee roll. In order to stop the reciprocation of the squeegee roll, the crank arm 37 can be removed from the shaft 38 so that the shaft 28 is not reciprocated during its rotation. Also, a repeat pattern can be applied to the sheet material by reciprocating the squeegee roll in timed relationship with its rotation. For example, the rotation of circular arm 39 can be terminated and the reciprocation of the squeegee roll will be the same for each revolution of the squeegee roll.

While this invention has been described in detail with particular reference to a preferred embodiment thereof, it will be understood that variations and modifications can be effected within the spirit and scope of the invention as described hereinbefore and as defined in the appended claims.

I claim:

1. A process of dyeing carpet with a pile surface comprising moving the carpet along its length with its pile surface facing downwardly, and as the carpet is moved along its length contacting the downwardly facing pile surface of the carpet with the upper surface of a dye pickup roll, rotating the dye pickup roll so that its upper surface progressively moves into contact with the carpet, applying dye to the lower surface of said dye pickup roll, engaging the dye pickup roll at a position after dye has been applied thereto and before the dye pickup roll contacts the carpet with a squeegee roll which is longer than the surface of the pickup roll that contacts the carpet and which defines a pattern of high and low surfaces spaced about its circumference, rotating the squeegee roll so that the surface of the squeegee roll that engages the surface of the dye pickup roll moves in the same direction as the adjacent surface of the dye pickup roll and its high surfaces remove some of the dye from the surface of the dye pickup roll and the dye applied by the pickup roll to the carpet is formed in a pattern that corresponds to the high and low surfaces of the squeegee roll, and reciprocating the squeegee roll at an amplitude such that the pattern of high and low surfaces of the squeegee roll continues to be applied to the pickup roll and to the carpet but the pattern of dye applied to the pickup roll and to the carpet is displaced along the length of the pickup roll and across the length of the carpet.

2. The process of claim 1 and wherein the steps of rotating and reciprocating the squeegee roll comprise reciprocating the squeegee roll in an out of phase relationship with respect to the rotation of the squeegee roll.

3. A process of applying dye to sheet material comprising the steps of advancing sheet material along its length, engaging the sheet material as it is being moved along its length with a dye pickup roll, rotating the dye pickup roll in a direction such that its area of contact with the sheet material moves in the same direction as the sheet material, applying dye to the dye pickup roll at a position away from contact between the sheet material and the dye pickup roll, engaging the dye pickup roll with a squeegee roll having a pattern of high and low contact areas spaced about its circumference at a position on the dye pickup roll after the dye has been applied to the dye pickup roll and before the dye has been carried by the dye pickup roll to the sheet material, rotating the squeegee roll in timed relationship with said dye pickup roll so as to remove some of the dye from the pickup roll with the high contact areas of the squeegee roll and to form a pattern of dye on the pickup roll with the low contact areas of the squeegee roll that corresponds to the pattern of high and low contact areas on the squeegee roll, reciprocating the squeegee roll with respect to the pickup roll so as to displace the pattern of dye formed by the squeegee roll on the pickup roll along the length of the pickup roll and carrying the pattern of dye on the pickup roll to the sheet material to create a random pattern of dye on the sheet material.

4. Apparatus for applying dye to the pile surface of carpet and the like comprising a dye pickup roll, means for applying liquid dye to said pickup roll, means for rotating said pickup roll, means for moving carpet along its length and for moving the pile surface of the carpet into contact with said dye pickup roll and in the direction of movement of the dye pickup roll, a squeegee roll extending parallel to and in contact with said dye pickup roll at a position in the direction of rotation of said dye pickup roll between the position where dye is applied to the pickup roll and where the pickup roll contacts the pile surface of the carpet, means for rotating and reciprocating said squeegee roll, said squeegee roll having a cylindrical surface with a plurality of depressions therein spaced about the circumference of the squeegee roll, whereby the surface of the squeegee roll that contacts the pickup roll tends to remove the liquid dye from the surface of the pickup roll and the depressions of the squeegee roll create a pattern in the dye on the dye pickup roll and the pattern of dye is carried by the dye pickup roll to the pile of the carpet.

5. The apparatus of claim 4 and wherein said squeegee roll is of a length longer than both the length of said dye pickup roll and the amplitude of reciprocation of the squeegee roll and continuously contacts the full length of the pickup roll during reciprocation.

6. The apparatus of claim 4 and wherein said means for applying dye to said pickup roll comprises a dye pan positioned beneath said dye pickup roll for maintaining liquid dye at a level high enough to contact said dye pickup roll and wherein said means for moving carpet along its length comprises means for moving carpet with its pile surface facing downwardly over the upper surface of said dye pickup roll and for urging the pile surface into engagement with said dye pickup roll.

7. In apparatus for applying liquid to sheet material wherein the sheet material is moved along its length into contact with a pickup roll and the liquid is applied to the pickup roll and transferred from the pickup roll to the sheet material, the improvement therein of a squeegee roll of a length longer than said pickup roll positioned parallel to and in contact with said pickup roll at a position between the position where the liquid is applied to the pickup roll and the position where the liquid is transferred to the sheet material, said squeegee roll having a cylindrical surface with depressions formed circumferentially about its surface, and means for rotating the squeegee roll in timed relationship with said pickup roll and for reciprocating said squeegee roll, whereby liquid on the pickup roll is formed into a pattern by the squeegee roll before it is transferred to the sheet material.

8. The invention of claim 7 and wherein said squeegee roll defines a plurality of depressions of random size, shape and depth.

9. The invention of claim 7 and wherein said squeegee roll is of a length longer than both the length of said pickup roll and the amplitude of reciprocation of the squeegee roll.

* * * * *